US005636588A

United States Patent [19]

Keller et al.

[11] Patent Number: 5,636,588

[45] Date of Patent: Jun. 10, 1997

[54] ANTENNA MOUNTED IDENTIFICATION MARKER

[76] Inventors: Jan Keller, 5804 Norton Rd., Alexandria, Va. 22303; Suzanne R. Geiger-Visci, 3057 S. Buchanan St., Arlington, Va. 22206

[21] Appl. No.: 583,747

[22] Filed: Jan. 17, 1996

[51] Int. Cl.[6] ..... G09F 21/04

[52] U.S. Cl. ..... 116/209; 116/28 R; 40/591

[58] Field of Search ..... 116/28 R, 173, 116/209; 40/591, 592

[56] References Cited

U.S. PATENT DOCUMENTS

| | | | |
|---|---|---|---|
| 1,595,395 | 8/1926 | Herbener | 116/173 |
| 2,420,772 | 5/1947 | Dalton . | |
| 2,858,793 | 11/1958 | Palmer . | |
| 3,433,203 | 3/1969 | Sharkey et al. . | |
| 3,526,050 | 9/1970 | Weller | 40/591 |
| 3,540,406 | 11/1970 | Dexter . | |
| 3,636,912 | 1/1972 | Kamp | 116/28 R |
| 3,712,263 | 1/1973 | Faragosa . | |
| 4,471,873 | 9/1984 | Thomas | 116/173 |
| 4,526,820 | 7/1985 | Haas | 116/28 R |
| 4,601,255 | 7/1986 | Marcotti | 116/173 |
| 4,960,067 | 10/1990 | Curie | 116/173 |
| 4,964,360 | 10/1990 | Henry | 116/28 R |
| 4,972,795 | 11/1990 | Mace . | |
| 4,989,536 | 2/1991 | Liming et al. . | |
| 5,016,372 | 5/1991 | Gold | 40/591 |
| 5,140,933 | 8/1992 | Nishina et al. . | |
| 5,176,099 | 1/1993 | Katz et al. . | |
| 5,246,517 | 9/1993 | Watson | 40/591 |

*Primary Examiner*—William A. Cuchlinski, Jr.
*Assistant Examiner*—Andrew Hirschfeld

[57] ABSTRACT

An identification device for mounting on the antenna of a transport vehicle. The device is tubular and resilient, and has a central cavity for receiving the antenna. A series of spaced apart external grooves selectively accept a tie constricting the tubular device about the antenna. The device has hook and loop material attached thereto, and a corresponding patch of hook and loop material. The corresponding patch is mounted to the vehicle, for temporary stowage of the identification device when not in use. The identification device has one or more distinctive bright colors, for being conspicuous at a distance. The device is preferably employed when parking a vehicle amidst many similar vehicles, thereby enabling an owner or operator to identify the vehicle.

2 Claims, 1 Drawing Sheet

ANTENNA MOUNTED IDENTIFICATION MARKER

BACKGROUND OF THE INVENTION

1. Field of the Invention

The present invention relates to apparatus for identifying an automobile. A cap of distinctive coloring is attached to the antenna. With the antenna in the raised position, the distinctive cap is readily discerned. This is particularly useful when the automobile is parked with many others, and the body thereof is concealed by the other vehicles.

2. Description of the Prior Art

It has frequently been a problem for an owner of a motor vehicle to identify his or her vehicle when it is parked in a lot among a great many others. Despite the fact that motor vehicles are built in a great many body styles and colors, any one particular vehicle may not be readily discernible when surrounded by others. In some cases, the body is obscured by other vehicles. In other cases, the vehicle is parked so far away from the site of an activity being attended by the owner or driver that the vehicle is still not readily visually identified.

The prior art has suggested identifying apparatus for addressing this problem. In particular, the prior art has provided conspicuous devices attached to the radio antenna of a vehicle. In this location, a distinctive visible beacon is located well above the vehicle body, where it is far more easily discerned than would be the case on the body of the vehicle. Examples include U.S. Pat. Nos. 3,433,203, issued to John F. Sharkey et al. on Mar. 18, 1969; 3,712,263, issued to Ernest Faragosa on Jan. 23, 1973; and 4,972,795, issued to Timothy A. Mace on Nov. 27, 1990. Sharkey et al. provide a spherical member made from a resilient material, such as foam rubber, which is partially impaled upon the antenna. The spherical member includes an internal tubular member for reinforcement. The device of Sharkey et al. is permanently attached to the antenna. By contrast with Sharkey et al., the present invention is tubular. Also, the present invention is monolithic in construction. An inexpensive tie is employed to secure the novel device to the antenna, rather than being permanently attached in the manner of Sharkey et al.

Faragosa provides a distinctive, brightly colored cylinder for clamping externally to the antenna. The present invention is mounted by impalement rather than by clamping, and further avoids complicated structure required by the clamp of the prior art device.

Mace provides a device which simulates a football helmet. Again, the present invention avoids the complicated construction seen in the prior art. In a further contrast to Mace and also to Faragosa, the present invention accommodates a degree of distortion by compression, should the antenna be retracted. The prior art devices are less able to cope with this eventuality by virtue of configuration.

Two prior art devices which mate in clamshell fashion about an antenna are seen in U.S. Pat. Nos. 4,989,536, issued to Richard E. Liming et al. on Feb. 5, 1991, and 5,176,099, issued to Paul C. Katz et al. on Jan. 5, 1993. Both of these prior art devices require a degree of precision molding or equivalent forming during fabrication, and are formed in two parts. The present invention abolishes any requirement for such precision, and is formed in a single part.

None of the above inventions and patents, taken either singly or in combination, is seen to describe the instant invention as claimed.

SUMMARY OF THE INVENTION

The present invention provides an uncomplicated, inexpensive device for identifying a transport vehicle from a distance, especially when the vehicle is parked or moored amidst many similar vehicles. It employs the antenna of the vehicle as a mast, elevating the identifying device above the body of the vehicle. The transport vehicle may be an automobile, a truck, a boat, an airplane, or any other vehicle for transporting people or freight.

Unlike many prior art devices, the present invention is extremely inexpensive, so that it is less likely to be the target of theft. Even if it should be stolen or vandalized, the cost is not so prohibitive as to discourage use of the device. Risk of excessive loss is a failing of many prior art devices, since these devices are located quite accessibly to bypassers.

The device comprises a tubular, resilient member open at one end to expose a cavity for receiving the antenna. Beyond low cost, the device is easily employed with many different vehicles and antennae, since the central cavity and resilient walls conform to different dimensions and configurations of the antenna.

The device is removable from the vehicle when not in use. For this purpose, a first patch of hook and loop fastening material is permanently attached to the device, and a corresponding patch of hook and loop material is mounted to a surface of the vehicle. The device is removed from the antenna and removably attached to the corresponding patch of fastener for stowage.

The device is optionally secured in place on the antenna by a constricting tie. Any inexpensive, discardable tie may be employed, such as an electrical cable tie. A series of spaced apart, circumferential grooves are disposed upon the tubular body of the device, for receiving the tie. This mode of attachment prevents easy removal, as for example by wind or due to petty theft.

Construction of the body accommodates unexpected retraction of the antenna. Relatively thin walls of the tubular configuration, in combination with fabrication from resilient and highly flexible foam rubber, enable the device to crumple or yield, should the antenna be retracted to the point that the device is drawn tightly against the body of the vehicle.

The device is brightly colored in one or more colors, so as to be conspicuous and distinctive.

Accordingly, it is a principal object of the invention to provide an identification device for removable mounting on the antenna of a transport vehicle.

It is another object of the invention to provide for temporary stowage of the identification device on the vehicle when the identification device is not in use.

It is a further object of the invention that the identification device be able to crumple should the antenna be retracted into the body of the vehicle.

Still another object of the invention is that the identification device be highly visible and conspicuous.

An additional object of the invention is to provide for secure attachment of the identification device to the antenna.

It is again an object of the invention to provide secure attachment by selectively locating a constricting tie around the identification device.

Yet another object of the invention is that the identification device be readily, manually removable from its stowed location on the vehicle.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
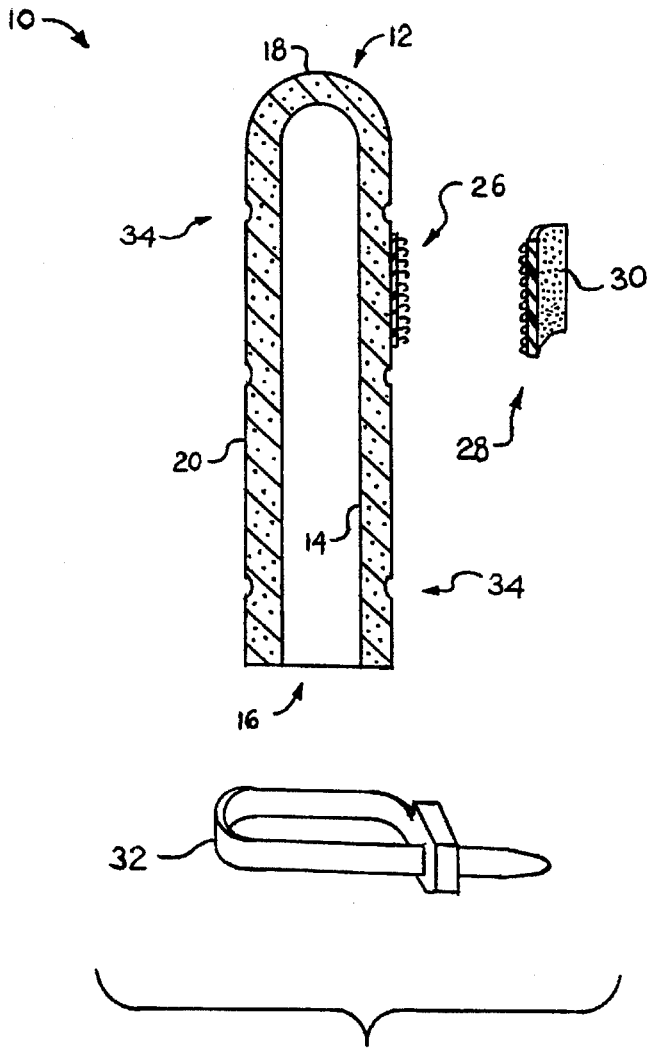
FIG. 1 is an exploded, side elevational, partially cross sectional view of the invention.
Figure 2:
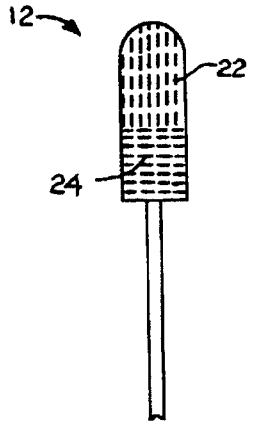
FIG. 2 is a diagrammatic representation of an exterior coloring scheme for visual purposes.

FIG. 1 shows the components of the novel identification device 10. A tubular body 12 formed from a resilient, flexible material, such as an expanded polymer or foam rubber, has a cavity 14 for receiving an antenna (see FIG. 2) of a transport vehicle (not shown in its entirety). Cavity 14 is coaxial with body 12, or longitudinally oriented with respect thereto, and is open at the bottom end 16 of body 12. The other end 18 is closed. This enables the antenna to be inserted into body 12. Interference at the closed end 18 maintains body 12 atop the antenna.

Body 12 has a brightly colored exterior surface 20. Body 12 may be entirely one color, or, as seen diagrammatically in FIG. 2, may have a pattern including two or more different colors 22 and 24.

Returning to FIG. 1, provision is made for manually and removably mounting device 10 to a surface of its associated transport vehicle when device 10 is not in use. A first patch 26 of hook and loop fastening material is secured to body 12 by adhesive, stitching, or by any other suitable method. A second patch 28 of complementary hook and loop fastening material is permanently attached to the transport vehicle in a predetermined, permanent location by adhesive 30, or in any suitable way. Device 10 is then stowed in this location when not in use, preferably in a protected location within the transport vehicle.

A radio antenna usually has an enlarged head (see FIG. 3) at its distal end. Device 10 has provision for receiving a constricting tie 32 which may be applied to body 12 below the enlarged head, to discourage casual theft or loss due to wind resistance at speed. Tie 32 is preferably any conventional self-binding tie which enables progressive tightening, but which opposes loosening. Such ties are commercially available as cable ties for the electrical industry and as bag ties for disposal bags.

A plurality of grooves 34 are disposed in spaced apart, circumferential relationship about the exterior of body 12 to allow selective, appropriate placement of tie 32 on body 12.

Figure 3:
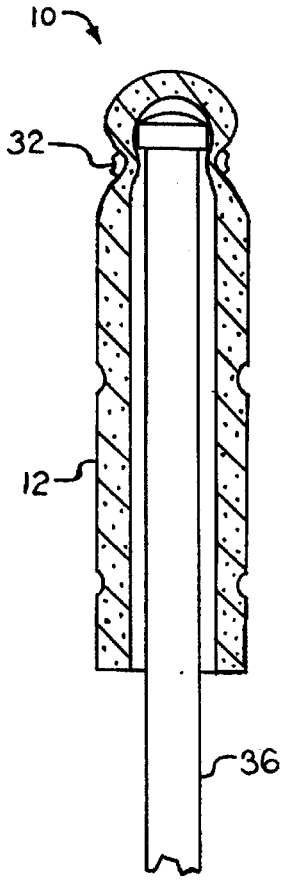
FIG. 3 is an environmental, side elevational, partially cross sectional view of the invention.

FIG. 3 shows device 10 installed on an antenna 36. A tie 32 is shown tightened about body 12 in the uppermost groove 34. A significant portion of body 12 is disposed beneath tie 32.

The configuration and material of body 12 combine to provide an important characteristic of device 10. That is, when the antenna is retracted, body 12 deforms and yields as the antenna is withdrawn into the body in vehicles equipped to permit automatic retraction of the antenna. Device 10 is not damaged, nor is the electric motor (not shown) powering the antenna. This characteristic is particularly desirable when a tie 32 is fastened in the arrangement of FIG. 3. In this arrangement, a considerable portion of body 12 is disposed beneath tie 32. If body 12 were not flexible, this portion could obstruct full retraction of antenna 36, thereby overworking the antenna motor.

It will be apparent to those of skill in the art that certain modifications and variations may be made to the embodiment of the invention described above. Body 12 may be of various dimensions and materials. In cases wherein the exterior of body 12 is not of a single color, color patterns may be varied as desired.

The number of grooves may be provided in any number, and spaced apart as desired. Attachment may be other than by hook and loop material. Tie 32 may be omitted in favor of a cord (not shown) or the like which lacks the ability to oppose slackening. Alternatively, the ability to oppose slackening may arise from elasticity of the material of the cord or its equivalent.

It is to be understood that the present invention is not limited to the embodiments described above, but encompasses any and all embodiments within the scope of the following claims.

We claim:

1. A visual identification device for mounting on an antenna of a transport vehicle, said identification device comprising:

a resilient, flexible, tubular member having a brightly colored exterior surface;

means defining a cavity within the tubular member for receiving the antenna, said cavity being coaxial with said tubular member; and tying means consisting of: (a) a plurality of circumferential grooves disposed on the exterior of said tubular member; and (b) a tie selectively positionable in any groove of said plurality of circumferential grooves.

2. A visual identification device comprising:

a resilient, flexible, tubular member for mounting on an antenna of a transport vehicle, said tubular member having a brightly colored exterior surface;

means defining a cavity within the tubular member for receiving the antenna, said cavity being coaxial with said tubular member;

tying means consisting of: (a) a plurality of circumferential grooves disposed on the exterior of said tubular member; and (b) a tie selectively positionable in any groove of said plurality of circumferential grooves; and means for manually and removably mounting said tubular member to a surface of the transport vehicle when the tubular member is not attached to the antenna, said means for manually and removably mounting comprising a first patch of hook and loop fastening material secured to said tubular member, and a second patch of complimentary hook and loop fastening material for permanent attachment to the surface of the transport vehicle, wherein said tubular member may be removably mounted to the surface of the transport vehicle when said tubular member is not attached to the antenna.

* * * * *